US005263721A

United States Patent [19]

Lowrance

[11] Patent Number: 5,263,721

[45] Date of Patent: Nov. 23, 1993

[54] END OF GAME FEATURE FOR A POP TARGET GAME

[75] Inventor: Arlen J. Lowrance, Tulsa, Okla.

[73] Assignee: Carl J. Lowrance, Tulsa, Okla.

[21] Appl. No.: 913,347

[22] Filed: Jul. 15, 1992

[51] Int. Cl.[5] ..... F41J 5/18

[52] U.S. Cl. ..... 273/390; 273/387; 273/383

[58] Field of Search ..... 128/378, 379, 383, 386, 128/387, 390, 375, 446, 391, 127, 392

[56] References Cited

U.S. PATENT DOCUMENTS

| | | | |
|---|---|---|---|
| 642,887 | 2/1900 | Uster | 273/387 |
| 817,401 | 4/1906 | Sholtz | 273/379 |
| 884,340 | 4/1908 | Northcraft | 273/379 |
| 1,267,722 | 5/1918 | Walter | 273/391 |
| 1,291,450 | 1/1919 | Eisenhauer | 273/387 |
| 1,680,167 | 8/1928 | Noda | 273/379 |
| 1,841,851 | 1/1932 | Temple | 273/390 |
| 2,185,628 | 1/1940 | Daum | 273/392 |
| 2,819,083 | 1/1958 | Schiffman | 273/375 X |
| 2,957,693 | 10/1960 | Ross | 273/446 X |
| 3,411,784 | 11/1968 | Lawrence | 273/340 X |
| 3,572,712 | 3/1971 | Vick | 273/375 X |
| 3,817,526 | 6/1974 | Bibb | 273/390 |
| 3,915,454 | 10/1975 | Saunders et al. | 273/127 X |
| 4,266,780 | 5/1981 | McQuary | 273/387 |

*Primary Examiner*—Mark S. Graham

*Attorney, Agent, or Firm*—William S. Dorman

[57] ABSTRACT

The invention is a feature for indicating which one of two contestants first strikes his assigned last swing-down target on a pop target game. The feature has two swing-down targets, one located on the left side of the game and one located on the right side of the game. Each swing-down target is mounted on a target end of an arm. A pivot end, provided on the arm opposite the target end, pivotally mounts by means of a collar onto a lower horizontal rod of the game. At the beginning of the game, the arms rest against a stop and a wand contacts the notched collar at solid portions located at 3:00 and 9:00 o'clock. When a contestant strikes one of the swing-down targets, the target pivots around the lower horizontal rod away from the stop, pivoting until its arm contacts one end of the wand, either the left or right end depending upon whether the left or right swing-down target was struck. Contact with the wand causes the wand to twist until it encounters the slots which lock the wand. Subsequently, when the other swing-down target is struck, the end of the locked wand opposite the end which was previously struck prevents the subsequently struck swing-down target from pivoting fully backwards. The position of the wand at the end of play indicates which of the two swing-down targets was struck first and thus which contestant is the winner.

6 Claims, 3 Drawing Sheets

END OF GAME FEATURE FOR A POP TARGET GAME

BACKGROUND OF THE INVENTION

1. Field of the Invention

The present invention is a feature for a pop target game which indicates which one of two contestants first completes knocking his assigned targets off the game's horizontal members. In the game, two contestants compete against each other in knocking off targets, with one swing-down target assigned to each contestant as the last target to be hit by that contestant. The end of game feature positively locks in one position whenever the first contestant strikes his final swing-down target prior to the second contestant striking his final swing-down target, thus locking out the second contestant. Alternately, the feature positively locks in a second position whenever the second contestant strikes his final swing-down target prior to the first contestant striking his final swing-down target, thus locking out the first contestant. The position of the feature at the end of the game indicates which contestant won the game by being the first contestant to strike his final swing-down target.

2. The Prior Art

Features for indicating which one of two contestants first hit a target are not new. However, prior art features are not designed for use by younger children. Younger children do not have accurate enough aim to hit small targets such as provided in some features. One such feature is U.S. Pat. No. 3,572,712 where the competitors must maintain a stream of water on a switch located within a small mouth-shaped opening.

Also, younger children are not able to throw a projectile very hard and, therefore, could not strike targets such as those revealed in U.S. Pat. No. 3,915,454 with sufficient force to lock out the other player.

Finally, complex games such as revealed in U.S. Pat. Nos. 2,185,628 and 2,957,693 would be expensive to purchase, could be broken by younger children, and possibly would be dangerous for use by younger children.

The present invention overcomes these prior art problems by providing a simple mechanical feature for indicating which one of two contestants first hits a target. The present invention employs large targets which can be struck by younger children, and the feature can be operated by a impact as weak as that of a rubber band. Because of the simplicity of the present invention, it is inexpensive, is not easily broken and does not present a danger to younger users.

3. Cross-Reference to Related Applications

This application constitutes an improvement over patent application Ser. No. 07/745,545 Pat. No. 5,180,170 filed on Aug. 15, 1991 for a "Microswitch Activating Device For Fishing Game Apparatus" by the inventor of the present invention and an improvement over patent application Ser. No. 07/835,367, pending filed on Feb. 14, 1992 for a "Fastener For Holding An Object Against The Side Of A Pipe" by the inventor of the present invention.

SUMMARY OF THE INVENTION

The present invention is a feature for indicating which of two contestants first completes popping the targets off his assigned side, i.e. either a right side or a left side, of a pop target game and striking a final swing-down target located on his assigned side, i.e. either a right swing-down target or a left swing-down target.

The pop target game is supported by a centerpost whose lower end is provided with a fork by which the game is impaled in the ground. An upper horizontal rod attaches perpendicularly to the centerpost at an upper end of the centerpost and a lower horizontal rod attaches perpendicularly to the centerpost at a point between the upper and lower ends of the centerpost. The upper and lower horizontal rods support a plurality of targets removably attached thereon, with the targets attached on the left side being equal in number to the targets attached on the right side.

The right swing-down target is mounted on a target end of a right arm; the right arm is provided with a pivot end opposite the target end; said pivot end pivotally mounts on the lower horizontal rod by means of a collar. Said right swing-down target and right arm are located on the right side of the centerpost. Similarly, a left swing-down target and left arm are provided on the left side of the centerpost.

A wand is rotatably mounted on a notched collar. The wand has a right end, a left end and a midpoint located midway between the two ends. Resilient means connect with the wand at the midpoint so as to urge the wand against the notched collar.

The notched collar is attached to an upper end of a vertical member; said vertical member is positioned behind the lower horizontal rod and spaced away from the centerpost. A lower end of the vertical member connects to the centerpost by means of an angled connection.

As viewed from the rear of the game, the notched collar is provided with four solid portions located at 12:00 o'clock, 3:00 o'clock, 6:00 o'clock and 9:00 o'clock positions around the collar. The notched collar is also provided with four slots, a slot located between adjacent solid portions.

A stop is mounted forward of the centerpost and slightly above the lower horizontal rod. At the beginning of the game, the left and right arms rest against the stop and the wand contacts the collar at the solid portions located at 3:00 and 9:00 o'clock. When a contestant strikes one of the swing-down targets, the swing-down target pivots around the lower horizontal rod away from the stop, beyond and behind the centerpost until it contacts the wand.

If the left swing-down target is struck before the right swing-down target, the left swing-down target pivots backward striking the left end of the wand, turning the wand until it encounters and locks into the slot provided between the solid portions located at 6:00 and 9:00 o'clock and the slot provided between the solid portions located at 12:00 and 3:00 o'clock. Subsequently, when the right swing-down target is struck, the right end of the wand prevents the right arm from pivoting backward, thus indicating that the contestant assigned to the left side was the winner.

Alternately, if the right swing-down target is struck before the left swing-down target, the right swing-down target pivots backwards striking the right end of the wand, turning the wand until it encounters and locks into the slot provided between the solid portions located at 3:00 and 6:00 o'clock and the slot provided between the solid portions located at 9:00 and 12:00 o'clock. Subsequently, when the left swing-down target is struck, the left end of the wand prevents the left arm from pivoting backward, thus indicating that the contestant assigned to the right side was the winner.

DETAILED DESCRIPTION OF THE PREFERRED EMBODIMENTS

Figure 1:
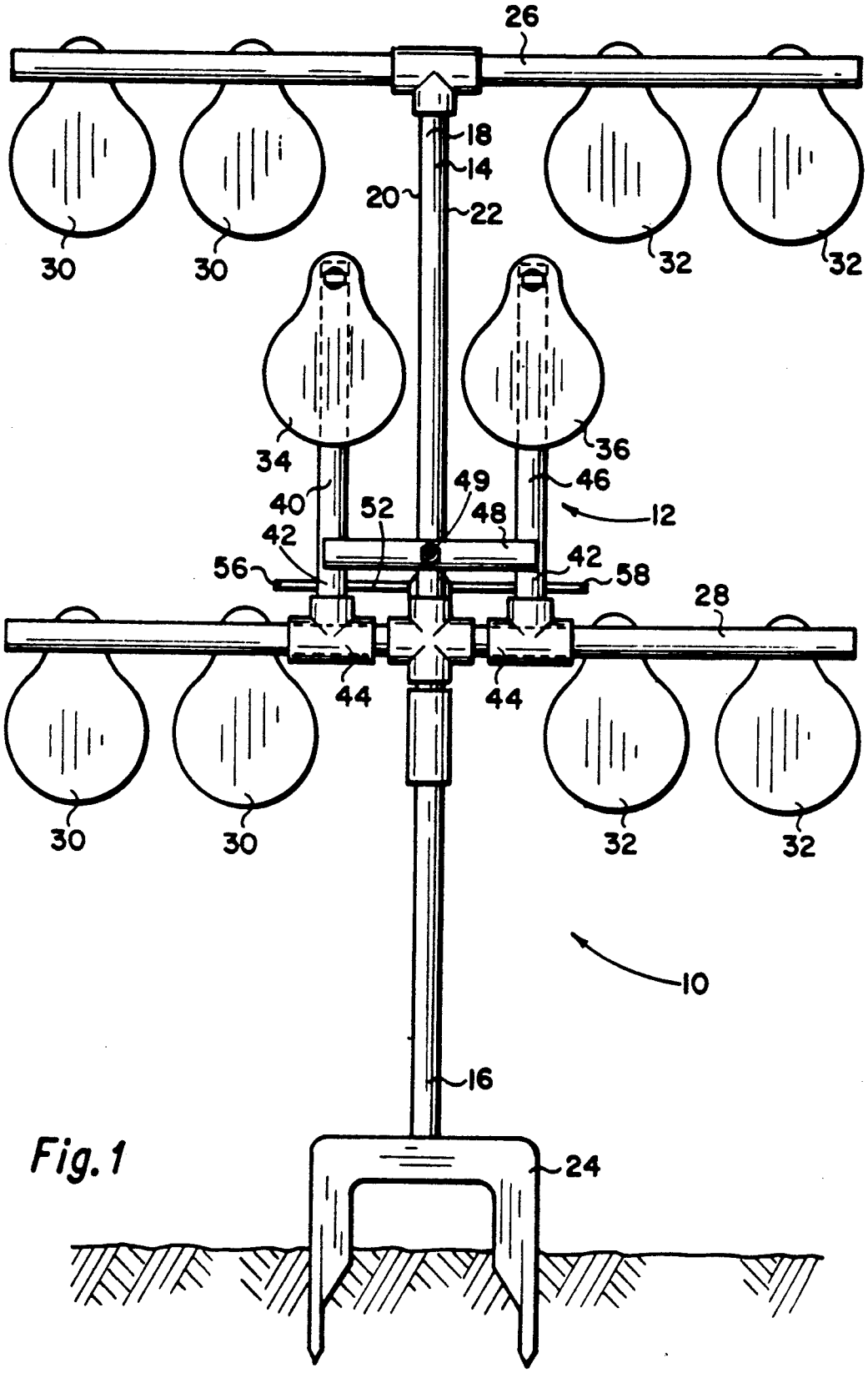
FIG. 1 is a front plan view of a pop target game incorporating the present invention as a end of game feature.

Referring now to the drawings and initially to FIG. 1, there is illustrated a pop target game 10 including an end of game feature 12. The game 10 includes a vertical centerpost 14 having a lower end 16 and an opposite upper end 18, a right side 20 and an opposite left side 22. Said centerpost 14 is impaled into the ground by means of a fork 24 provided on the lower end 16 of the centerpost 14. An upper horizontal rod 26 attaches perpendicularly to the centerpost 14 at the upper end 18 and a lower horizontal rod 28 attaches perpendicularly to the centerpost 14 at a point between the upper end 18 and the lower end 16.

The horizontal rods 26 and 28 support a plurality of right and left targets 30 and 32 removably attached thereon, with right targets 30 attached on the right side 20 and left targets 32 attached on the left side 22. The right targets 30 are equal in number to the left targets 32. One means of attaching the right and left targets 30 and 32 to the horizontal rods 26 and 28 is a fastener for holding an object against the side of a pipe as embodied in patent application Ser. No. 07/835,367 filed on Feb. 14, 1992 by the present inventor. However, the present invention is not limited regarding means of attaching the right and left targets 30 and 32.

To play the game, each contestant is first assigned a side, either the right side 20 or the left side 22. Then the contestants utilize projectiles (not shown), such as darts, rubber bands, balls, etc., to impact the right and left targets 30 or 32 on their assigned sides, either 20 or 22. When the right and left targets 30 and 32 are impacted, they are knocked off the pop target game 10. After a contestant has knocked all the targets 30 or 32 off his assigned side, either 20 or 22, he strikes a final swing-down target, either a right swing-down target 34 or a left swing-down target 36, located on his assigned side, either the right side 20 or the left side 22.

The right swing-down target 34 is mounted on a target end 38 of a right arm 40. The right arm 40 is provided with a pivot end 42 opposite the target end 38; said pivot end 42 pivotally mounts on the lower horizontal rod 28 by means of a collar 44. Said right swing-down target 34 and right arm 40 are located on the right side 20 of the centerpost 14.

Similar to the right swing-down target, the left swing-down target 36 is mounted on a target end 38 of a left arm 46. The left arm 46 is provided with a pivot end 42 opposite the target end 38; said pivot end 42 pivotally mounts on the lower horizontal rod 28 by means of a collar 44. Said left swing-down target 36 and left arm 46 are located on the left side 22 of the centerpost 14.

A stop 48 is horizontally mounted forward of the centerpost 14 and slightly above the lower horizontal rod 28. A bolt 49 or other suitable means mounts the stop 48 to the game 10. At the beginning of the game, the arms 40 and 46 will rest against the stop 48, as shown in FIGS. 1, 2 and 3.

When a contestant strikes one of the swing-down targets, either 34 or 36, the swing-down target, either 34 or 36, will pivot around the lower horizontal rod 28 away from the stop 48 in the direction of the arrow 50, beyond and behind the centerpost 14 until it contacts a wand 52 as will be explained hereafter.

Figures 2, 3:
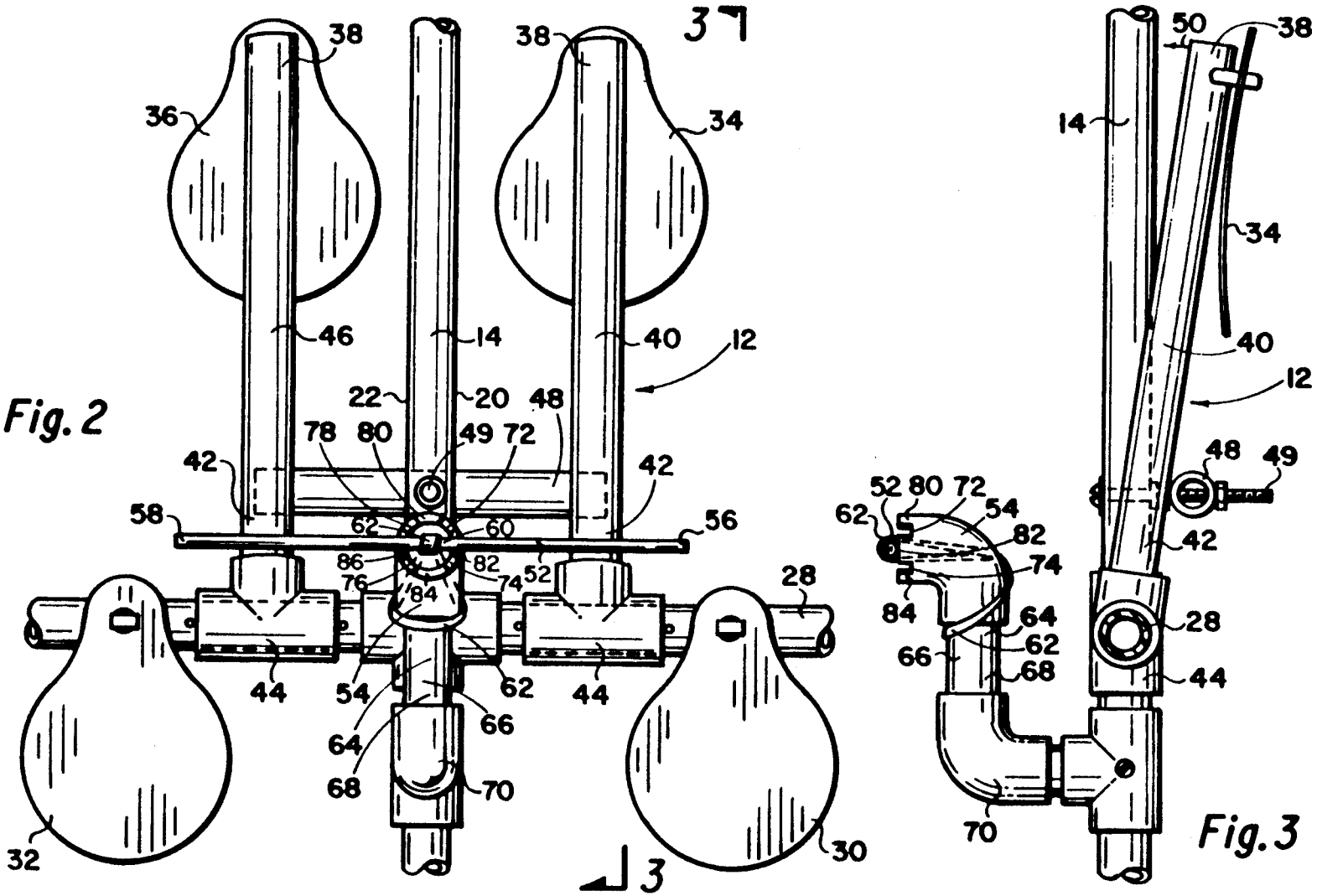
FIG. 2 is a partial rear elevation of the pop target game shown in FIG. 1.
FIG. 3 is a right side elevation taken along line 3—3 of FIG. 2 showing the present invention in the forward position as it would be at the start of the game.

As best shown in FIGS. 2 and 3, the wand 52 is rotatably mounted on a notched collar 54. The wand 52 has a right end 56 which is an associating end for the right arm 40, as will be explained infra. The wand 52 has a left end 58 which is opposite the right end 56 and which is an associating end for the left arm 46, as will be explained infra. The wand also has a midpoint 60 located midway between the two ends 56 and 58. Resilient means 62, such as a rubber band or string, connect with the midpoint 60 of the wand 52 so as to urge the wand 52 against the notched collar 54.

The notched collar 54 is attached to an upper end 64 of a vertical member 66; said vertical member 66 is positioned behind the lower horizontal rod 28 and spaced away from the centerpost 14. The vertical member 66 is provided with a lower end 68 opposite its upper end 64; said lower end 68 connects to the centerpost 14 by means of an angled connection 70.

As shown in FIGS. 2 and 3, the notched collar 54 is provided with four slots 72, 74, 76 and 78 and with four solid portions 80, 82, 84 and 86. The slots 72 through 78 are located between the solid portions 80 through 86 so that when the game 10 is viewed from a rear elevation as in FIG. 2, beginning at a 12:00 o'clock position and moving clockwise, the solid portions 80 through 86 and the slots 72 through 78 are encountered in the following order: 80, 72, 82, 74, 84, 76, 86 and 78. Thus, solid portion 80 is at the 12:00 o'clock position, solid portion 82 is at a 3:00 o'clock position, solid portion 84 is at a 6:00 o'clock position and solid portion 86 is at a 9:00 o'clock position.

At the beginning of the game, the wand 52 is positioned horizontally so that it contacts the notched collar 54 at solid portions 82 and 86.

Figure 4:
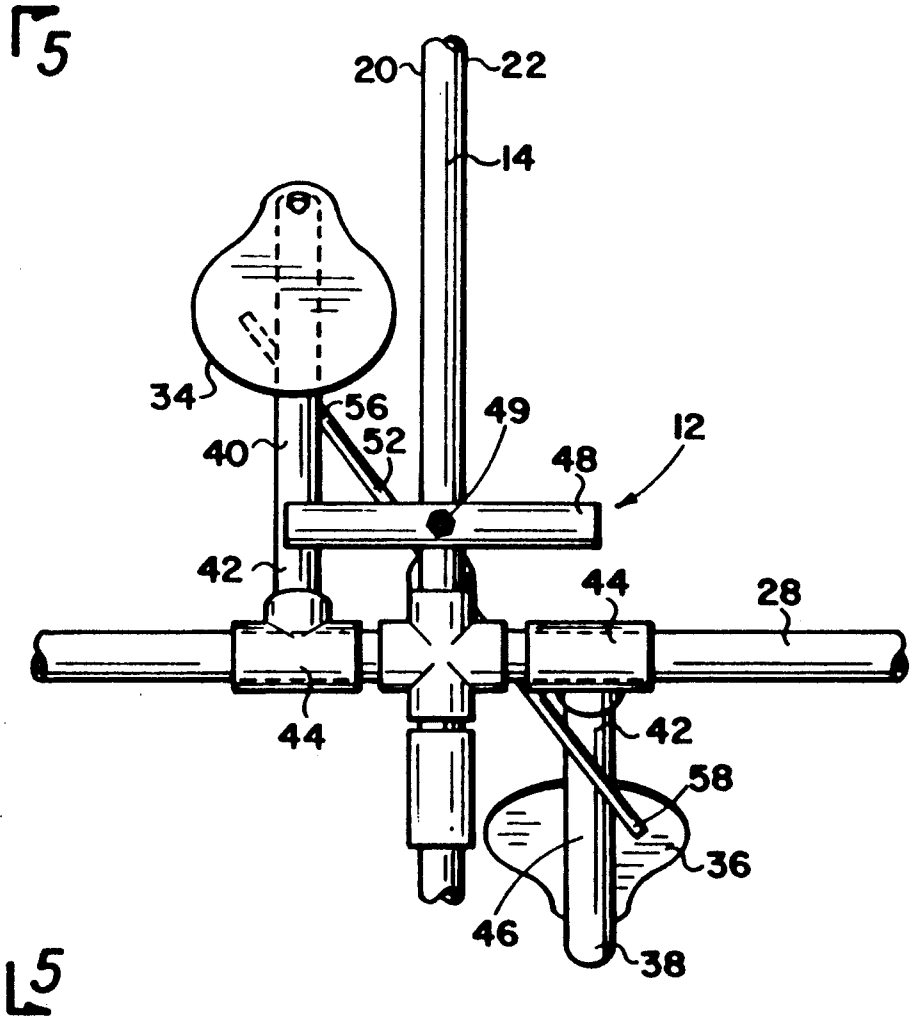
FIG. 4 is a partial front plan view of the pop target game showing the present invention in the rearward tripped position as it would be at the conclusion of the game.
Figure 5:
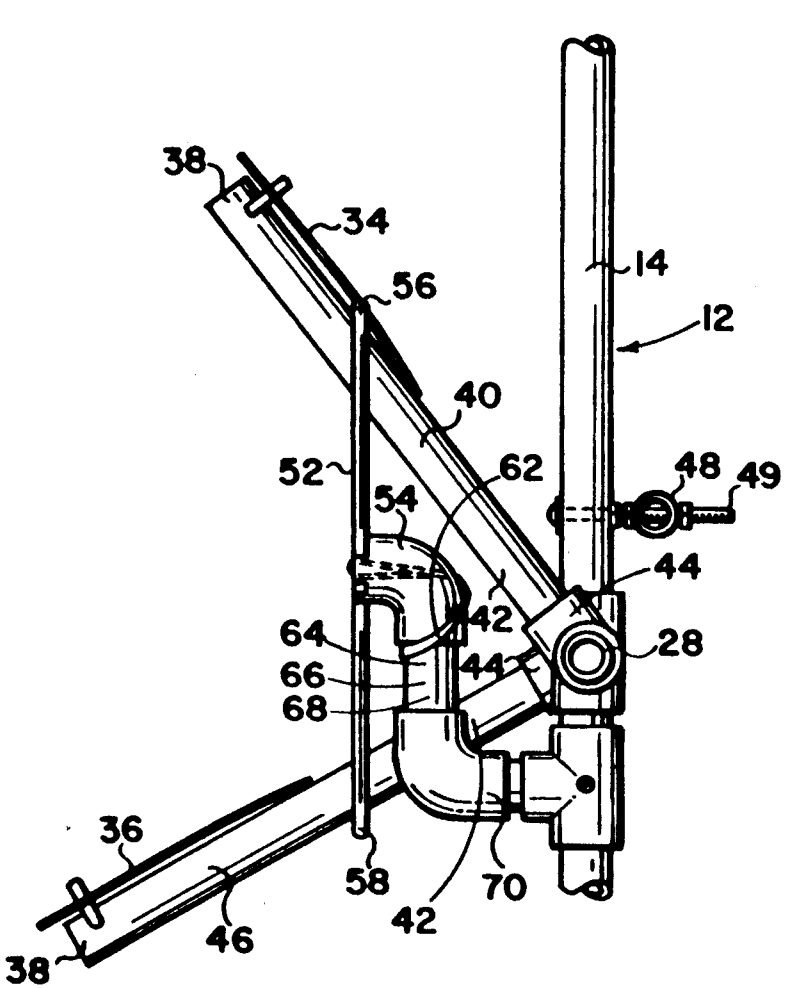
FIG. 5 is a right side elevation taken along line 5—5 of FIG. 4.

If, for example, the left swing-down target 36 was hit by a projectile (not shown) before the right swing-down target 34 was hit, the left swing-down target 36 would pivot backward and the left arm 46 would strike its associating end, i.e. the left end 58, of the wand 52, moving the wand 52 into the slots 72 and 76, as shown in FIGS. 4 and 5. The left arm 46 of the left swing-down target 36 would then be resting against the left end 58 of the wand 52. Once the wand 52 is engaged by the slots 72 and 76, the resilient means 62 will lock the wand 52 in place and will prevent the wand 52 from being moved again without first manually lifting the wand 52 rearward and then turning it.

If the right swing-down target 34 was hit thereafter, the right end 56 of the wand 52, which associates with the right arm 40, would prevent the right arm 40 from pivoting fully backward, i.e. as far back as the left swing-down target 36 which was previously struck, thus locking out the right arm 40 and the right swing-down target 34. At this point, the left swing-down target 36 would be considered lower since the right swing-down target 34 would be essentially upright, thus indicating that the left swing-down target 36 had been hit first and that the contestant assigned to the left side 22 was the winner.

Likewise, if the right swing-down target 34 was hit by a projectile (not shown) before the left swing-down target 36 was hit, the right arm 40 would pivot backward and hit the right end 56 of the wand 52, moving the wand 52 into the slots 74 and 78 where the wand 52 would be locked into position. The right arm 40 of the right swing-down target 34 would then be resting against the right end 56 of the wand 52.

If the left swing-down target 36 was hit thereafter, the left end 58 of the wand 52 would prevent the left arm 46 from pivoting fully backward, thus locking out the left arm 46 and the left swing-down target 36. At this point, the right swing-down target 34 would be considered lower since the left swing-down target 36 would be essentially upright, thus indicating that the right swing-down target 34 had been hit first and that the contestant assigned to the right side 20 was the winner.

To begin a new game, the removable right and left targets 30 and 32 are reattached to the horizontal rods 26 and 28, the right and left swing-down targets 34 and 36 are pivoted forward to rest against the stop 48, and the wand 52 is lifted rearward and then turned to reposition it so it rests against solid portions 82 and 86 of the notched collar 54.

Whereas, the present invention has been described in particular relation to the drawings attached hereto, it should be understood that other and further modifications, apart from those shown or suggested herein, may be made within the spirit and scope of this invention.

What is claimed is:

1. A feature for indicating which contestant first strikes his assigned swing-down target on a game comprising:

a game with at least two swing-down targets, each swing-down target being mounted on an arm, said arms pivotally mounted on a horizontal rod provided on the game, a means for holding the swing-down targets upright prior to the swing-down targets being struck, a wand rotatably mounted on a notched collar, said wand provided with at least two ends; each of said ends being associated with one of the arms, means attaching to the wand to urge the wand against the notched collar, the notched collar being attached to the game behind the horizontal rod and spaced away from the game so that when one of the swing-down targets is struck, the swing-down target pivots backward on its arm to strike its associating end of the wand and rotates the wand, means provided on the notched collar for locking the wand when the wand is struck so that the other swing-down target or targets are prevented from pivoting fully backward when subsequently struck.

2. A feature according to claim 1 wherein the means for locking the wand when the wand is struck is comprised of solid portions provided on the notched collar at 12:00 o'clock, 3:00 o'clock, 6:00 o'clock and 9:00 o'clock positions as viewed from a rear elevation of the game and slots being located between adjacent solid portions

3. A feature according to claim 1 further comprising:

the notched collar being attached to an upper end of a vertical member, said vertical member being positioned behind the horizontal rod and spaced away from the game, a lower end of the vertical member being connected to the game by means of an angled connection.

4. A feature according to claim 1 wherein the arms pivotally mount on the horizontal rod by means of a collar.

5. A feature according to claim 1 wherein the means for holding the swing-down targets upright prior to being struck is a stop mounted on the game forward and slightly above the horizontal rod against which the arms rest.

6. A feature for indicating which contestant first strikes his assigned swing-down target on a game comprising:

a game with at least two swing-down targets, each swing-down target being mounted on a target end of an arm, each arm being provided with a pivot end opposite the target end, each pivot end being pivotally mounted by means of a collar onto a horizontal rod of the game so that the swing-down targets pivot backward when struck, a stop being mounted on the game forward and slightly above the horizontal rod so that the arms rest against the stop prior to the swing-down targets being struck, a wand rotatably mounted on a notched collar, said wand having a right end, a left end and a midpoint located between the left and right ends, means connecting with the wand at the midpoint so as to urge the wand against the notched collar, the notched collar being attached to an upper end of a vertical member, said vertical member positioned behind the horizontal rod and spaced away from the game, a lower end of the vertical member being connected to the game by means of an angled connection, four solid portions being provided on the notched collar respectively at 12:00 o'clock, 3:00 o'clock, 6:00 o'clock and 9:00 o'clock positions as viewed from a rear elevation of the game, the notched collar being provided with four slots, a slot being located between adjacent solid portions so that when one of the ends of the wand is struck by an arm, the wand locks in a slanted position thus preventing the other arm from pivoting fully backward.

* * * * *